US009897353B2

(12) United States Patent
Szabo et al.

(10) Patent No.: US 9,897,353 B2
(45) Date of Patent: Feb. 20, 2018

(54) HYBRID CONDENSER

(71) Applicant: GEA EGI Energiagazdalkodasi ZRT., Budapest (HU)

(72) Inventors: Zoltan Szabo, Budapest (HU); Andras Balogh, Budapest (HU); Laszlo Ludvig, Budapest (HU); Attila Gregasz, Budapest (HU)

(73) Assignee: GEA EGI Energiagazdalkodasi ZRT., Budapest (HU)

( * ) Notice: Subject to any disclaimer, the term of this patent is extended or adjusted under 35 U.S.C. 154(b) by 206 days.

(21) Appl. No.: 14/425,963

(22) PCT Filed: Sep. 20, 2013

(86) PCT No.: PCT/HU2013/000095
§ 371 (c)(1),
(2) Date: Mar. 4, 2015

(87) PCT Pub. No.: WO2014/045071
PCT Pub. Date: Mar. 27, 2014

(65) Prior Publication Data

US 2015/0253047 A1 Sep. 10, 2015

(30) Foreign Application Priority Data

Sep. 20, 2012 (HU) ..... P 1200544

(51) Int. Cl.
*F25B 39/04* (2006.01)
*F28B 5/00* (2006.01)

(52) U.S. Cl.
CPC ..... *F25B 39/04* (2013.01); *F28B 5/00* (2013.01)

(58) Field of Classification Search
CPC ..... F25B 39/04; F28B 5/00
(Continued)

(56) References Cited

U.S. PATENT DOCUMENTS 2,939,685 A * 6/1960 Worn ..... F28B 1/02 165/114
3,194,021 A 7/1965 Peake et al.
(Continued)

FOREIGN PATENT DOCUMENTS

DE 1014568 8/1957
DE 1426887 5/1969
(Continued)

OTHER PUBLICATIONS

European Patent Office, International Search Report and the Written Opinion of the International Searching Authority of corresponding PCT/HU2013/00095, dated Mar. 24, 2014.

*Primary Examiner* — Charles Bushey
(74) *Attorney, Agent, or Firm* — Wood Herron & Evans LLP

(57) ABSTRACT

The invention is a hybrid condenser having a direct contact condenser segment (9) and a surface condenser segment (10) arranged in a common condensation space. The hybrid condenser includes a surface condenser segment (10) arranged downstream the direct contact condenser segment (9) in the direction of steam flow or below the direct contact condenser segment (9), and a water guiding element (17) ensuring that the cooling water and condensate mixture generated in the direct contact condenser segment (9) flows downward avoiding the surface condenser segment (10).

6 Claims, 11 Drawing Sheets

(58) Field of Classification Search
USPC ..... 261/115, 118, DIG. 10
See application file for complete search history.

(56) References Cited

U.S. PATENT DOCUMENTS

| | | | | |
|---|---|---|---|---|
| 3,391,911 | A | 7/1968 | Heller et al. | |
| 3,511,481 | A * | 5/1970 | Daltry | F01D 25/14 165/110 |
| 3,520,521 | A | 7/1970 | Heller et al. | |
| 3,635,042 | A | 1/1972 | Spangemacher | |
| 3,831,667 | A | 8/1974 | Kilgore et al. | |
| 3,898,867 | A * | 8/1975 | Andersson | F25B 39/04 261/153 |
| 5,154,227 | A * | 10/1992 | Csaba | F28B 3/04 165/111 |
| 6,233,941 | B1 | 5/2001 | Youssef | |
| 8,567,768 | B2 * | 10/2013 | Iwata | F28B 3/04 261/115 |

FOREIGN PATENT DOCUMENTS

| | | | |
|---|---|---|---|
| DE | 1451133 | | 4/1970 |
| EP | 0467878 | | 1/1992 |
| FR | 877696 | A | 12/1942 |
| GB | 186122 | | 6/1921 |
| WO | 2011067619 | A2 | 6/2011 |

* cited by examiner

HYBRID CONDENSER

TECHNICAL FIELD

The invention relates to a significant element, the so-called hybrid condenser, of water-saving dry/wet cooling systems used primarily for cooling of power plant cycles.

BACKGROUND ART

Surface condenser, the condenser broadly applied in power plant cooling has been known for more than a century. Steam turbines fitted with surface condenser may be cooled either by wet, i.e. evaporative cooling systems, or by a dry cooling system. The central element of the approach described in FR 877 696 covering Prof. László Heller's invention is the so-called direct contact condenser (i.e. mixing condenser) which can be applied instead of the usual surface condenser in power plant cycles. The direct contact condenser makes dry (air) cooling more efficient. The system so implemented is generally called a Heller-system.

In the technical field, the joint application of surface and direct contact condensers in combined dry/wet cooling systems has emerged repeatedly. Most of the related publications do not offer actual design solutions for the hybrid condenser. One of the first patent documents relating to combined dry/wet cooling systems, U.S. Pat. No. 3,635,042 additionally describes a condenser in the schematic diagram of the cooling system, where the injection of dry system cooling water is shown in the surface condenser body. A similar schematic diagram is depicted in U.S. Pat. No. 3,831,667. In this case, according to FIG. 1, the cooled water coming from the dry cooling circuit is injected at a higher location with respect to the tubes of the cooling surface associated with the wet cooling circuit. The known arrangement of having one unit above the other is not advantageous, because about fifty times as much water as the quantity of condensate generated outside the tubes of the surface condenser is poured onto the tubes. Therefore, the path of steam flow between the tubes is mostly blocked and the cooling effect of the surface condenser tubes is deteriorated, because due to the condensing of one part of the steam, the already heated up water coming from the dry cooling circuit functions as an insulating layer between the wall of the tubes cooled from inside and the not yet condensed steam.

A hybrid condenser associated with a so-called plume abating wet/dry tower is described, and a related schematic construction diagram is also presented in U.S. Pat. No. 6,233,941 B1. In FIG. 2 of the document, the two condenser parts are arranged in separate housings, which not only entails extra costs, but also results in an extra pressure drop, i.e. in the deterioration of efficiency, because of the branching of the expanded steam. FIG. 1 of the document shows a solution, where the surface and direct contact condenser parts are located within one housing. One part of the exhaust steam from the turbine condenses on the surface condenser; this part of the steam flow is subjected to cooling first. The steam which is not condensed here and the steam which bypasses the surface condenser are condensed in the space assigned to the direct contact condenser. Arranging the condenser parts side by side significantly enlarges the required condenser cross section, which results in a cost increase. The known arrangement may only be used at the most in the combined wet and dry mode of operation, and hence the purely dry operation desirable in cold weather, when the functioning of the direct contact condenser part is required only, is therefore inefficient. The surface condenser part comprises the conventionally applied elements, and the direct contact condenser part reflects the design of Heller's direct contact condenser. According to the prior art solution, a steam baffle plate is arranged between the surface condenser part and the direct contact condenser part, and the plate is designed to turn the steam path partly into a counter-flow with the water introduced into the direct contact condenser. It is to be noted that because the baffle plate is arranged in the path of the steam flow directed to the direct contact condenser, the application of this baffle plate results in a substantial steam pressure drop. It is also a disadvantage that the steam is introduced into the direct contact condenser part as a vortex after repeated changes of direction, which again deteriorates the efficiency of the condenser part.

A dry/wet cooling system is described in WO 2011/067619 A2, which is aimed at significant annual water saving in comparison with the purely wet cooling system. According to the document, the two separated dry and wet cooling circuits may be integrated partly through water-water heat exchangers, and partly through a hybrid condenser. The large annual water saving (70 to 90% with respect to the purely wet cooling system) necessitates the running of the cooling system in both purely dry and varying wet assisted modes. One of the most important components of the system is a hybrid condenser, which comprises in a single condenser body the direct contact condenser which utilises the cooling effect of the dry cooling circuit, and the surface condenser which uses the cooling effect of the wet cooling circuit. The document does not provide information about the preferred structure and design of a hybrid condenser.

A number of documents introduce separate direct contact or surface condenser solutions, as well as their auxiliary equipment. DE 1 014 568 discloses equipment for dumping turbine bypass steam into a surface condenser. U.S. Pat. No. 3,520,521 discloses sectionalized heavy duty condensers. Both EP 0 467 878 A1 and DE 1 451 133 disclose direct contact condensers.

To implement the condensation of exhaust steam from the turbine, the available space is limited both horizontally and in depth, especially in the case of a steam flow leaving the turbine downwards, which is the most common approach. In lateral directions, the support columns of the turbine table and in depth the machine hall baseplate and the NPSH (net positive sucktion head) requirement of condensate extracting pumps represent restrictions. This necessitates that the hybrid condenser shall be a compact equipment, and it is also desirable to avoid any potential negative reaction of the two condenser parts on each other. Prior art approaches failed to resolve these issues.

DESCRIPTION OF THE INVENTION

The object of the invention is to provide a solution for the design and preferred layout of a hybrid condenser, which eliminates the disadvantages of prior art solutions as much as possible. The object of the invention furthermore is to create a hybrid condenser, which enables efficient condensation adjusted to the restrictions above, and eliminates negative feedbacks as much as possible. The object of the invention is especially the creation of a hybrid condenser by which deteriorating of the operation of the surface condenser segment by the cooling water of the direct contact condenser segment can be avoided.

The need leading to the creation of the invention was that no information had been given in prior art documents about a hybrid condenser structure which could be applied efficiently and flexibly in typical power plant cooling systems. In our experiments we have recognised that it is not advantageous, if the steam flow coming from the turbine is exposed first to the surface condenser segment in the condenser. This is because water cooled by wet cooling flows in the tubes of the surface condenser, and the temperature thereof is generally much lower than that of the water cooled by dry cooling and sprayed by the nozzles of the direct contact condenser. The steam arriving from the turbine must on the one hand get through the tube bundles which exert a substantial drag force, and on the other hand, due to the relatively lower temperature of the tubes, the steam may be subjected to considerable undercooling, which deteriorates the efficiency from the aspect of steam cycles. The steam pressure loss caused by the drag force of tubing also results in additional undercooling.

The direct contact condenser has the best efficiency, if it receives the steam along relatively straight flow lines, transversally to the direction of cooling water sprayed by the nozzles.

Therefore, according to the invention, a hybrid condenser is provided, in which at least the majority of the inlet steam is first exposed to the direct contact condenser segments. In this case, on the one hand, the inlet steam may enter the system in straight flow directions favourable from the aspect of operation, transversally to the cooling water sprayed by the nozzles, and on the other because of the relatively warmer cooling water resulting from dry cooling, the steam is not subjected to undercooling. In this case, however, an additional problem arises.

The essence of the problem is that in the common condensation space of the hybrid condenser, a cooling water/condensate mixture flows onto the surface condenser segment arranged in the direction where natural condensation processes take place, i.e. in the direction of steam flow downstream the direct contact condenser segment or physically below the direct contact condenser segment, and this extremely deteriorates the efficiency of the surface condenser segment. According to the invention we have recognised that if appropriate water guiding elements are arranged in the common condensation space, which elements guide away the cooling water and condensate mixture so that it avoids the surface condenser segments, an extremely advantageous and efficient design can be achieved.

The objects of the invention have been achieved by the hybrid condenser described in claim 1. Preferred embodiments of the invention are defined in the dependent claims.

BRIEF DESCRIPTION OF THE DRAWINGS

Preferred embodiments of the invention will now be described by way of exemplary drawings in which.

EMBODIMENTS OF THE INVENTION

Figure 1:
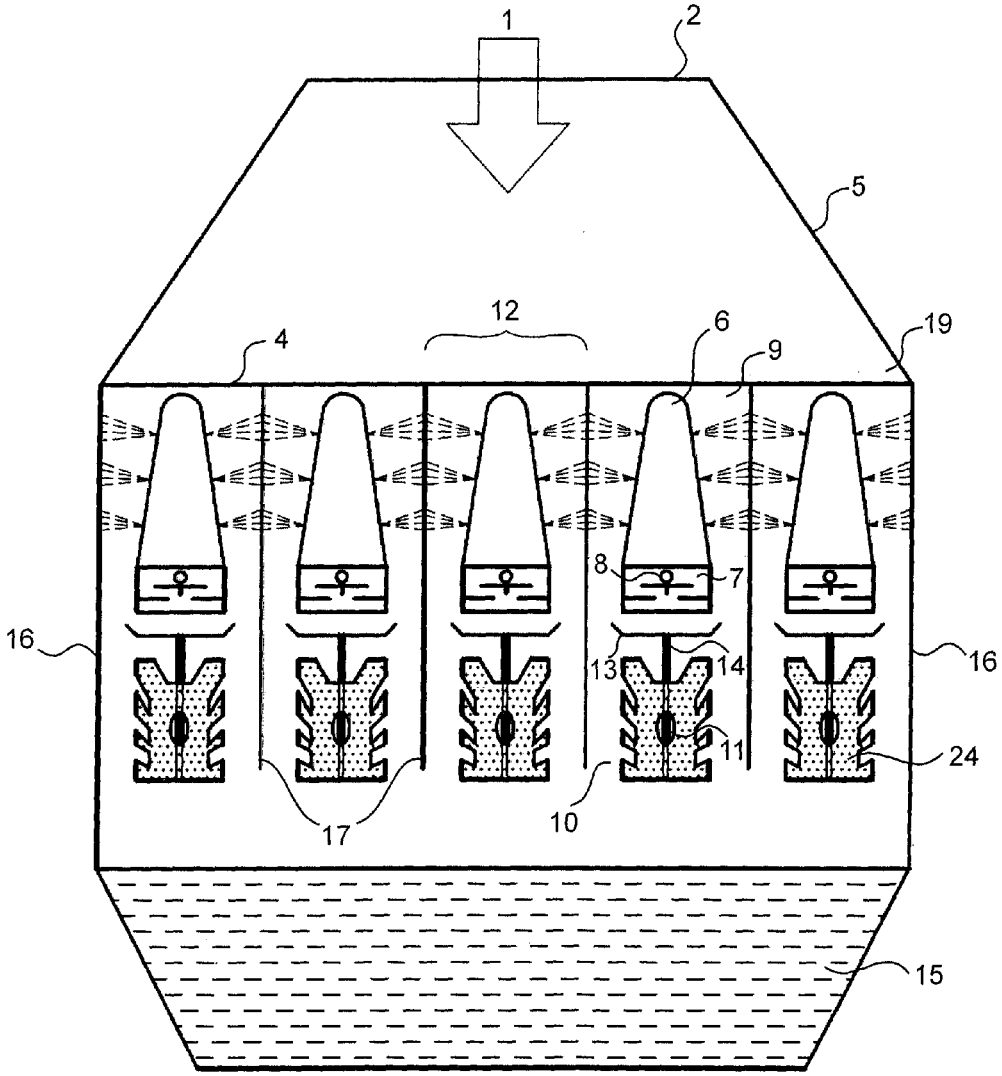
FIG. 1 is a schematic structure of a hybrid condenser containing modules consisting of series connected direct contact and surface condenser segments, in the case of down exhaust steam from the turbine.

A preferred embodiment of the invention built of modules is shown in FIG. 1. Expanded steam 1 flows downwards over the outlet cross section of a low pressure steam turbine 2 not shown in the figure, into a transition piece (neck-piece) 5 of a hybrid condenser. Through the inlet cross section of the hybrid condenser 4, the steam 1 reaches direct contact/surface condenser modules 12 from the neck piece with a growing cross section.

The arrangement based on the modules 12 ensures that in the horizontal plane, the dimensions of the hybrid condenser do not exceed those of either a conventional surface or a direct contact condenser. At the same time, regarding the depth of the condenser, there is no substantial increase in size due to the solutions to be described below, as a result of the condenser segments which maintain or further increase efficiency.

In the upper space of the modules 12, a direct contact condenser segment 9, and in the space below, in the direction of steam flow downstream the direct contact condenser segment 9, a surface condenser segment 10 is located, i.e. the two condenser segments are connected in series with each other with respect to the flow and condensation of the steam 1. As shown in the figure, the direct contact condenser segments 9 and the surface condenser segments 10 are arranged in a common condensation space. In the direct contact condenser part, some of the inlet steam 1 is condensed on the film-like water jets which are crosswise in relation to the direction of steam flow and come from the nozzles of distributing chamber 6 of the direct contact condenser segment 9. A smaller proportion of the steam flowing on from here (all the remaining steam, if only the direct contact condenser segment is in operation) is condensed in a counter-flow after-cooler 7 belonging to the direct contact condenser segment 9 and located below the distributing chambers 6; the condensation takes place for example in a perforated plate or fill type after cooler 7 on the effect of cooling water taken from the bottom end of the cooling water distributing chamber 6. The non-condensible gases can be rejected from space 8 assigned to air suction within the after-cooler 7. The steam remaining after the direct contact condenser segment 9 is condensed on the outer surface of tubes 24 running along the length of the hybrid condenser and located in the surface condenser segment 10, under the effect of the cooling water flowing in the tubes 24, and coming from the wet cooling system. In addition to the cross sectional arrangement depicted by FIG. 1, the surface condenser segment 10 may take any usual shape, like a Christmas tree shape, a V-shape, a pear shape, etc. Within the surface condenser segment 10, an appropriate space is designed for the purpose of air rejection 11.

The efficient operation of the surface condenser segment 10 necessitates that the mixture of a large volume of heated up cooling water and condensate coming from the direct contact condenser segment 9 avoids the surface condenser segment 10. From the nozzles of the distributing chamber 6 of the direct contact condenser segment 9, the cooling water hits the nozzle facing water receiving surface of water guiding element 17 arranged between the neighbouring modules 12, and the mixture of cooling water and condensate flows down along these water guiding elements 17 to a level corresponding to the bottom of the surface condenser segments 10. So, the water films ejected by the direct contact condenser segment 9 and leading to the condensation of steam reach and are guided by the water guiding elements 17 separating the modules 12 from each other, and they flow down along the water guiding elements without contacting the cooling tubes of the surface condenser segment 10 below. The water guiding elements 17 may be made of plate or of a perforated flat material, for example a dense wire mesh held by a frame structure.

Figure 2:
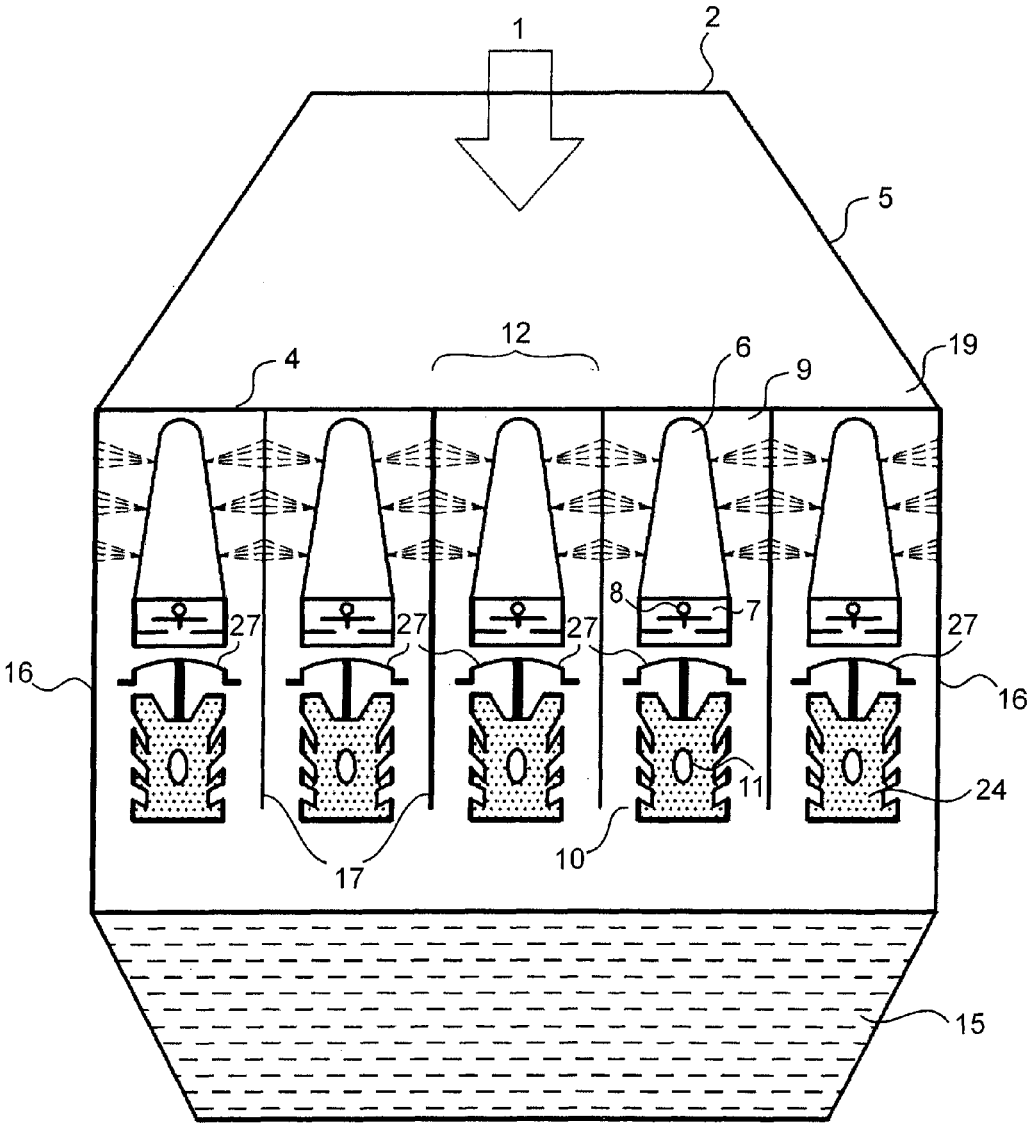
FIG. 2 is a schematic structure of a hybrid condenser similar to that shown in FIG. 1.

The cooling water flow reaching the space of the after-cooler 7 is generally only 1 to 5% of the cooling water flow emitted in the form of water films, but it is necessary that even this water volume should not on the tubes of the surface condenser segment 10. The water drain of the after-cooler space is designed accordingly, with a further water guiding element. According to FIG. 1, the cooling water and condensate mixture coming from the after-cooler 7 of the direct contact condenser segment 9 is collected by a tray 13, from which one or more water draining pipes 14 conduct it to below the surface condenser segment 10. In accordance with the alternative structure presented in FIG. 2, instead of the water collecting tray 13 and the water draining pipe 14, an umbrella-shape water spreading element 27 may be applied, located below the after-cooler 7 of the direct contact condenser. This element sprays the water towards the water guiding elements 17 located on the two sides, thereby avoiding that the water contacts the cooling tubes 24 of the surface condenser segment 10. In the embodiment shown in both FIG. 1 and FIG. 2, the cooling water and condensate mixture from the above mentioned water draining and guiding elements, and the condensate from the external surface of the tubes 24 of the surface condenser segment 10 are supplied to a condensate and cooling water collecting space 15. From here, water extruction and circulating pumps known per se not shown in the figures forward a smaller part of the collected fluid into the feedwater circuit and a bigger part thereof to the dry cooling circuit.

Figure 3:
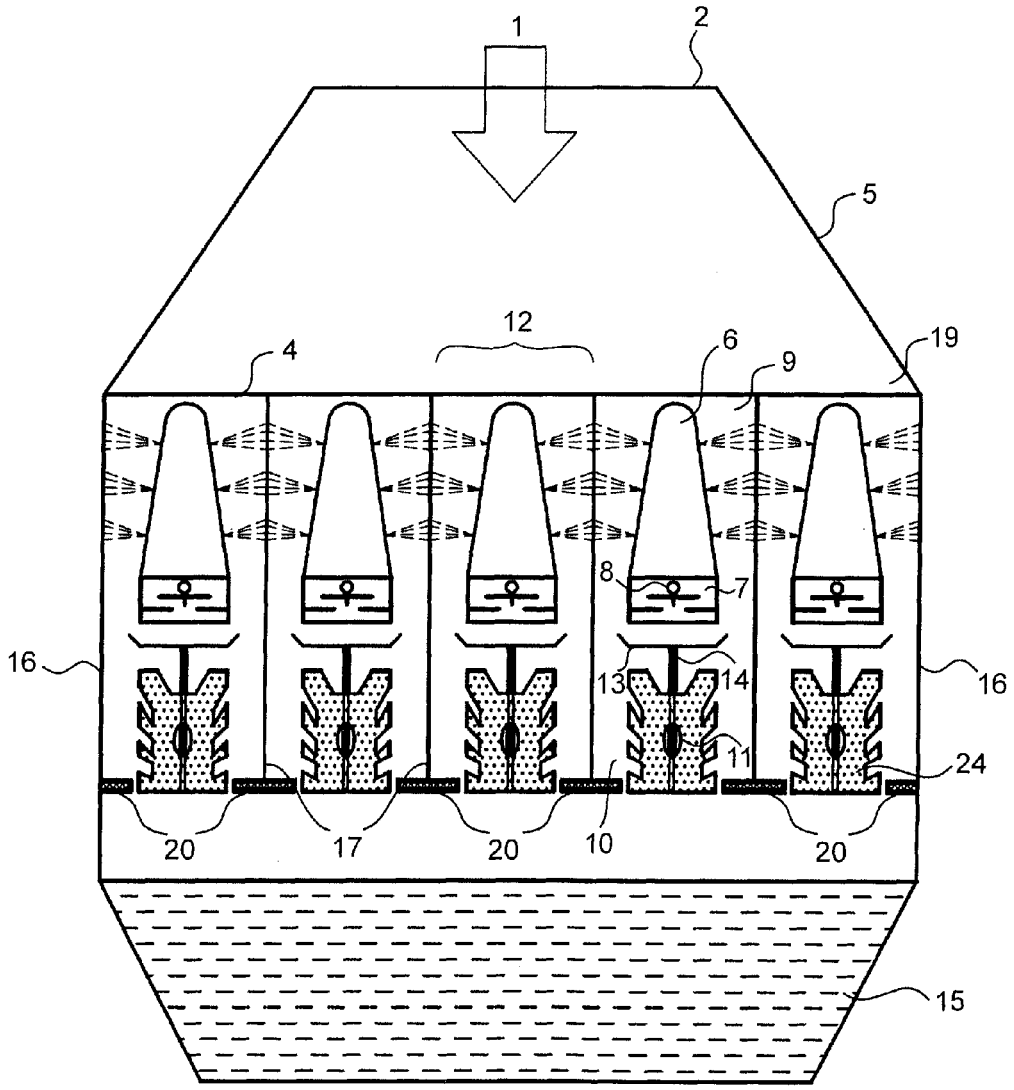
FIG. 3 is a schematic structure of an embodiment having members connected to the end of module separating elements, which members turn the water flowing down on the walls into a large surface water spray.

FIG. 3 shows a partly enhanced version of the embodiment depicted by FIG. 1. The series connected direct contact/surface condenser modules 12 of the hybrid condenser with a similar layout differ from the structures presented earlier (FIGS. 1 and 2) in that at the end of the water guiding elements 17 separating the modules, and preferably on each of two sidewalls 16 of the condenser, aligned with the bottom ends of the water guiding elements 17, a (sprinkler) element 20 for generating water spray is located. The element 20 may preferably be a perforated plate, a wire mesh or a strip of fill, which turns the warmed up cooling water and condensate mixture flowing down on both sides of the water guiding elements 17 into a large surface water spray. This improves further the extructing of the non-condensing gases from the fluid phase.

Figure 4:
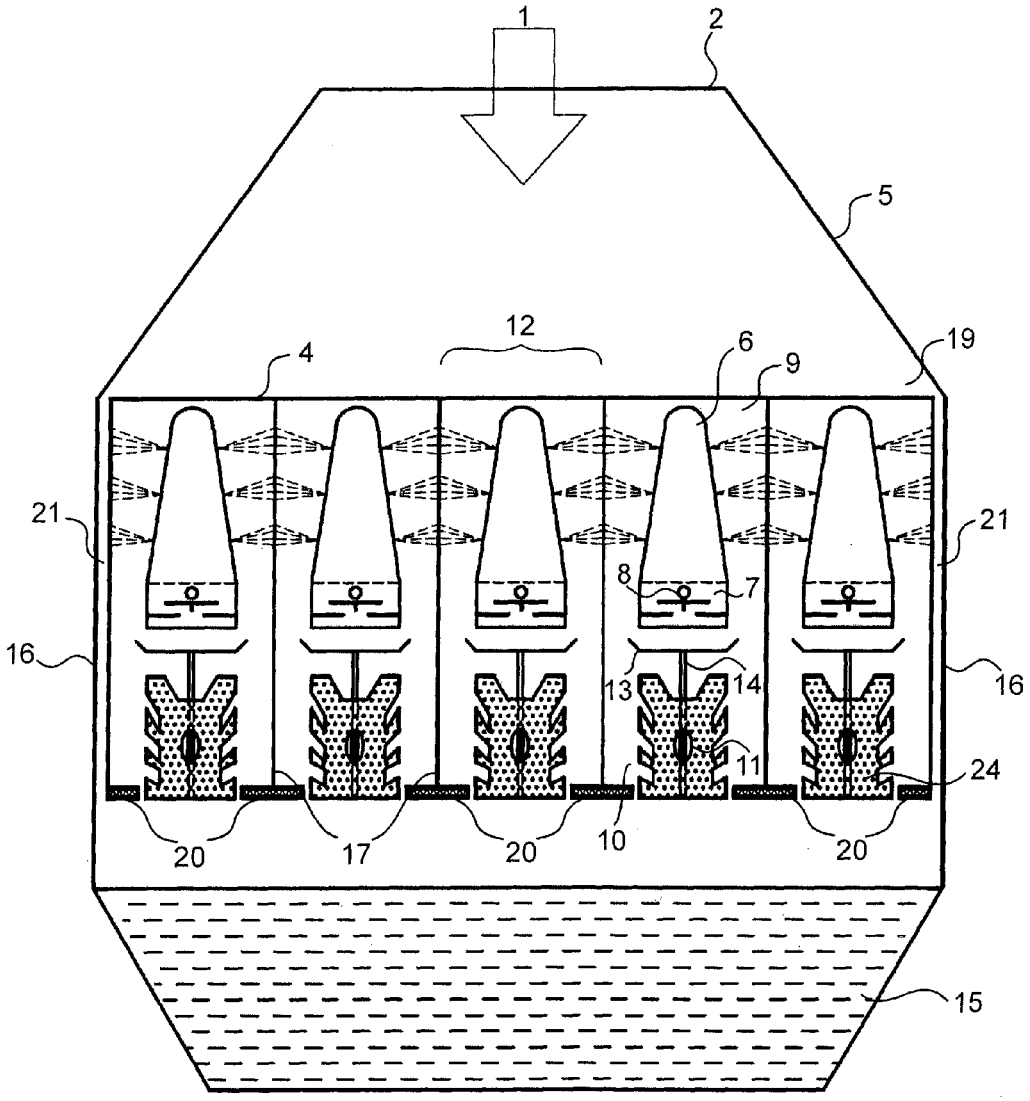
FIG. 4 is a schematic structure of an embodiment having a gap along the lateral confining walls, which enables the bypassing of condenser modules for a small proportion of the steam flow leaving the turbine.

FIG. 4 shows a further improved version of the solution depicted by FIG. 3. Along each of the two sidewalls 16 of the hybrid condenser, a thin gap 21 is formed, through which the expanded steam 1 coming from the turbine may flow directly between the water surface of the condensate and cooling water collecting space 15 and the bottom of the series connected direct contact/surface condenser modules 12, where it is condensed on the spray or water jets formed by the water spray generating elements 20, thereby further improving the extructing of the non-condensing gases and at the same time reducing the undercooling of the cooling water and condensate mixture. Therefore, on the external side of each outermost module 12 there is also a water guiding element 17 arranged with appropriate spacing from the respective sidewalls 16 of the hybrid condenser, creating the gap 21 which enables a steam flow that bypasses the modules 12.

Figure 5:
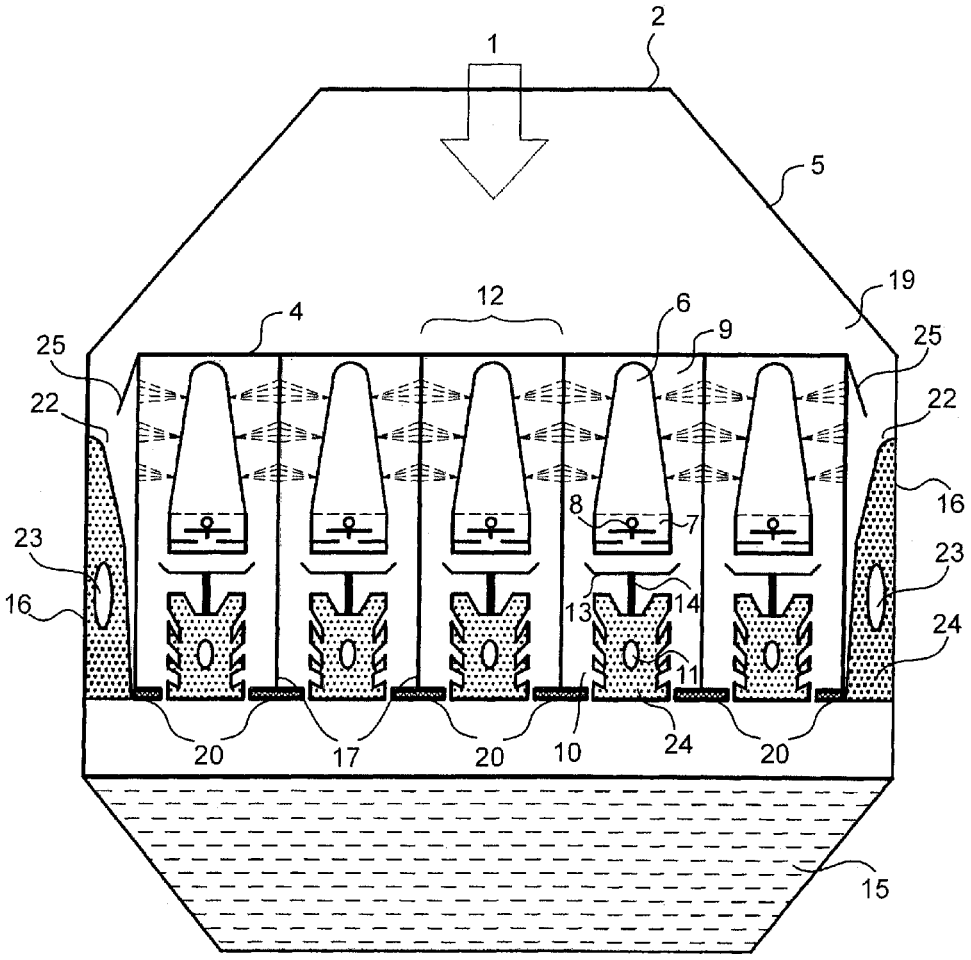
FIG. 5 is a schematic structure of an embodiment having an extra surface condenser module and guiding plate along the two side walls, as well as a reduced transition piece (neck-piece) angle.

FIG. 5 shows such a preferred embodiment of the invention, which may be applied in the case when it is permissible in the horizontal plane to increase the size of hybrid condenser slightly, and it is necessary (at least in the hottest part of the year) to expand the surface of the surface condenser part connected to the wet cooling circuit. In this case, at unchanged downward turbine exhaust flange dimensions, it is necessary to decrease the angle 19 between the side contour of a transition piece (neck-piece) 5 and the horizontal. The so increased inlet cross section 4 of the condenser may be utilised without deteriorating the efficiency of the direct contact condenser segments 9 in a way that, in the extra spacing obtained as a result of increased width, along the two sidewalls 16 of the hybrid condenser, surface condenser segments 22 are fitted, only. Similarly to the series connected surface condenser segments 10, they also have a space 23 which enables air rejection. To assist flow to this point, optionally a steam guiding plate 25 can be used. In this arrangement, the direct contact condenser spaces remain in the plane that includes a favourable angle with the turbine outlet, whereas due to the colder cooling water, the decreasing of the inlet angle is practically tolerated without a drop in efficiency by the additional parallel connected surface condenser segments 22. In this way, the total surface area of the surface condenser can be increased without extending the total condenser body height.

Figure 6:
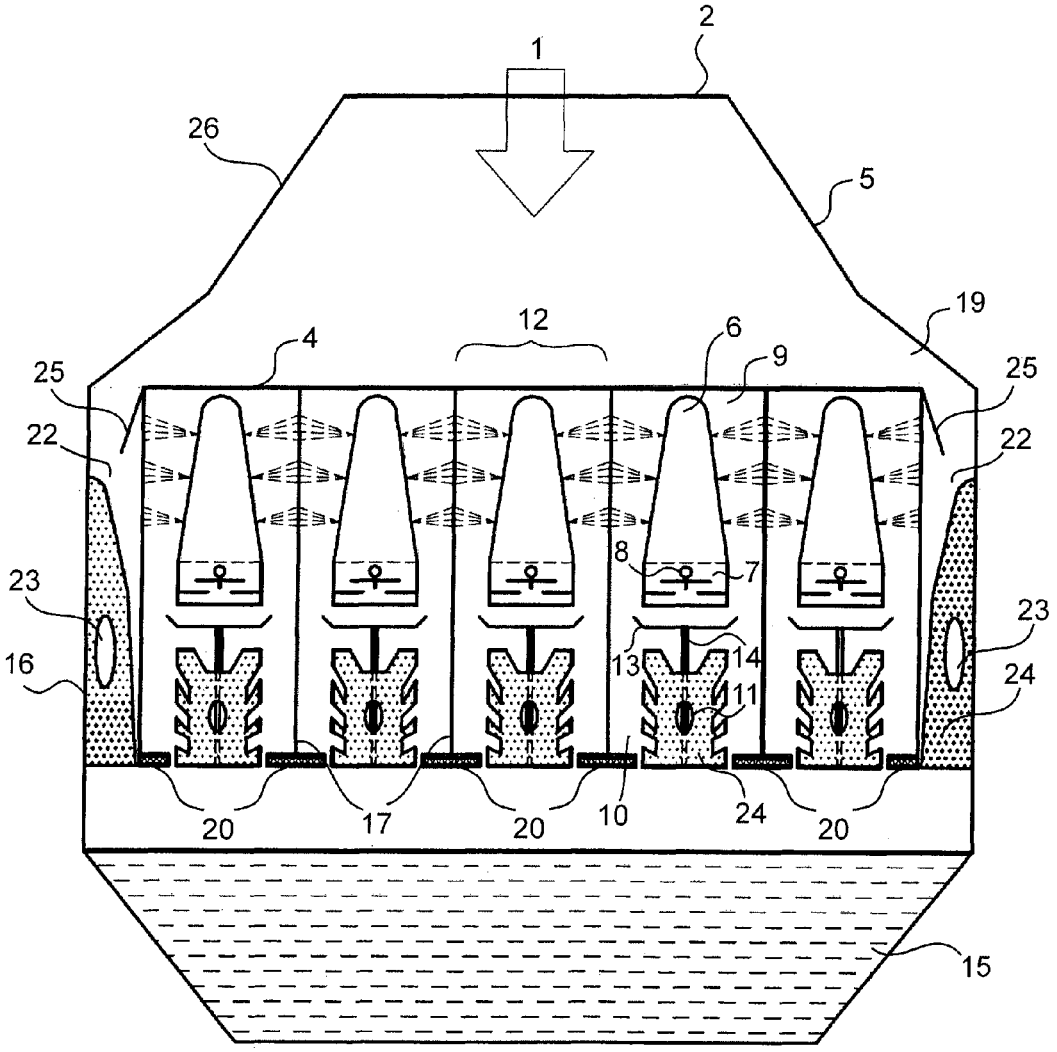
FIG. 6 is a schematic structure of an embodiment similar to that shown in FIG. 5, where the transition piece (neck-piece) have two angles and adjoins the wider condenser through the smaller angle.

FIG. 6 shows a structure nearly identical to that presented in FIG. 5. The only difference is in the line of the transition piece (neck-piece) 5, because instead of the side contour which has a reduced angle throughout, the whole transition fitting section 26, only its lower part has a smaller angle, and as proven by the results of our flow experiments, it further improves primarily the conditions of steam flow to the direct contact condenser segments 9.

Figure 7:
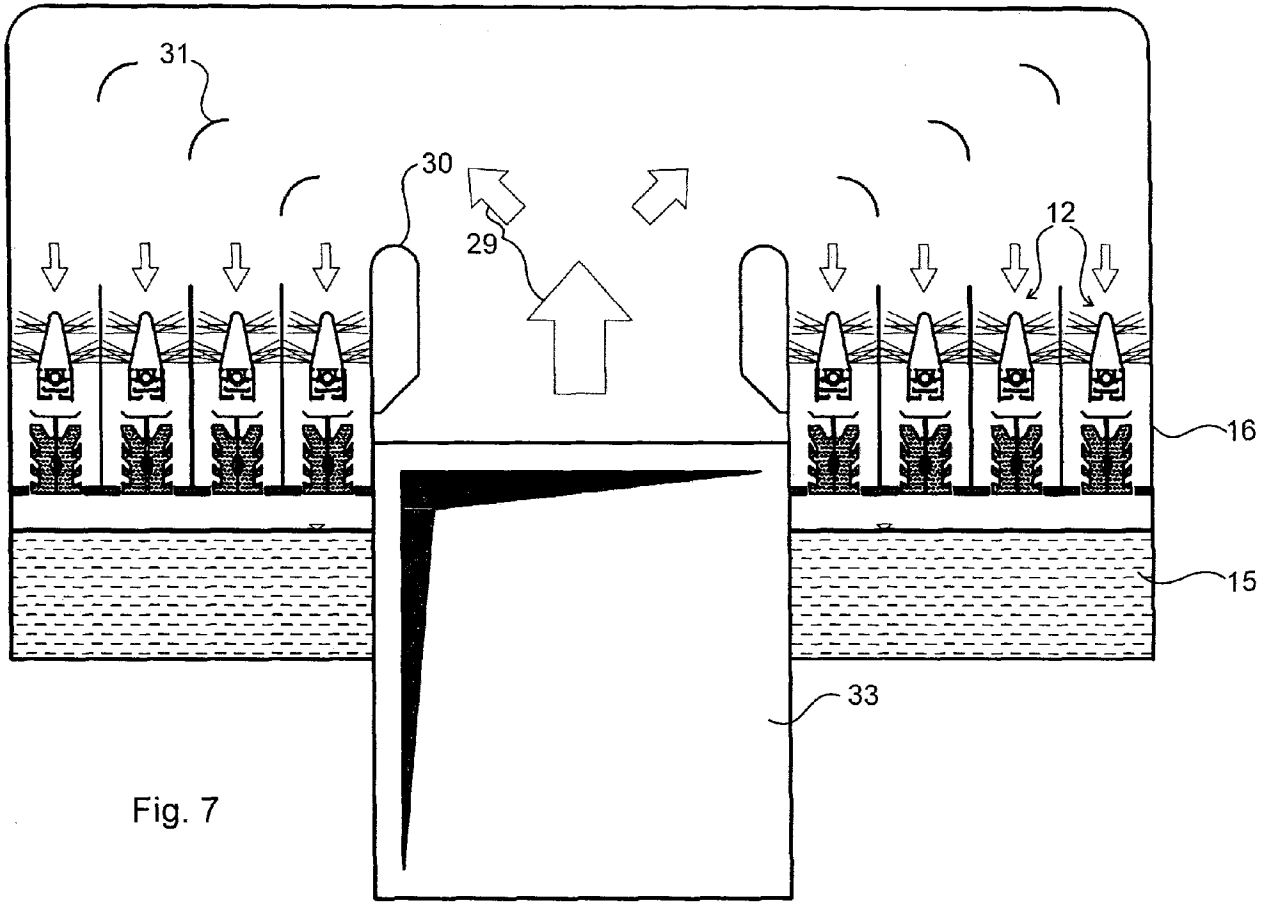
FIG. 7 is a schematic structure of a hybrid condenser according to the invention connected to an axial or lateral exhaust turbine.

While FIGS. 1 to 6 show hybrid condensers designed for condensing the steam 1 flowing downwards from the low pressure housing of the steam turbine, FIG. 7 presents an embodiment of the hybrid condenser connected to an axial or lateral exhaust steam turbine. Steam 29 supplied by the turbine in a horizontal direction (the viewing direction of the figure) enters a transition piece through an inlet cross section 33 located in a plane perpendicular to the horizontal. The transition piece turns the steam flow by 90° with respect to the horizontal, and by means of steam guiding elements 30 and 31, the steam takes a 180° turn, and flows to a location above the series connected direct contact/surface condenser modules 12 in the hybrid condenser, and enters the modules 12 by flowing downwards. Thereby, the modules 12 shown in FIGS. 1 to 6 may be applied practically without any change in this embodiment as well. FIG. 7 shows modules 12 which are identical with those presented in FIG. 3. As a result of the steam 29 flowing downwards, any arrangement presented in FIGS. 1 to 6 may be applied.

Figure 8:
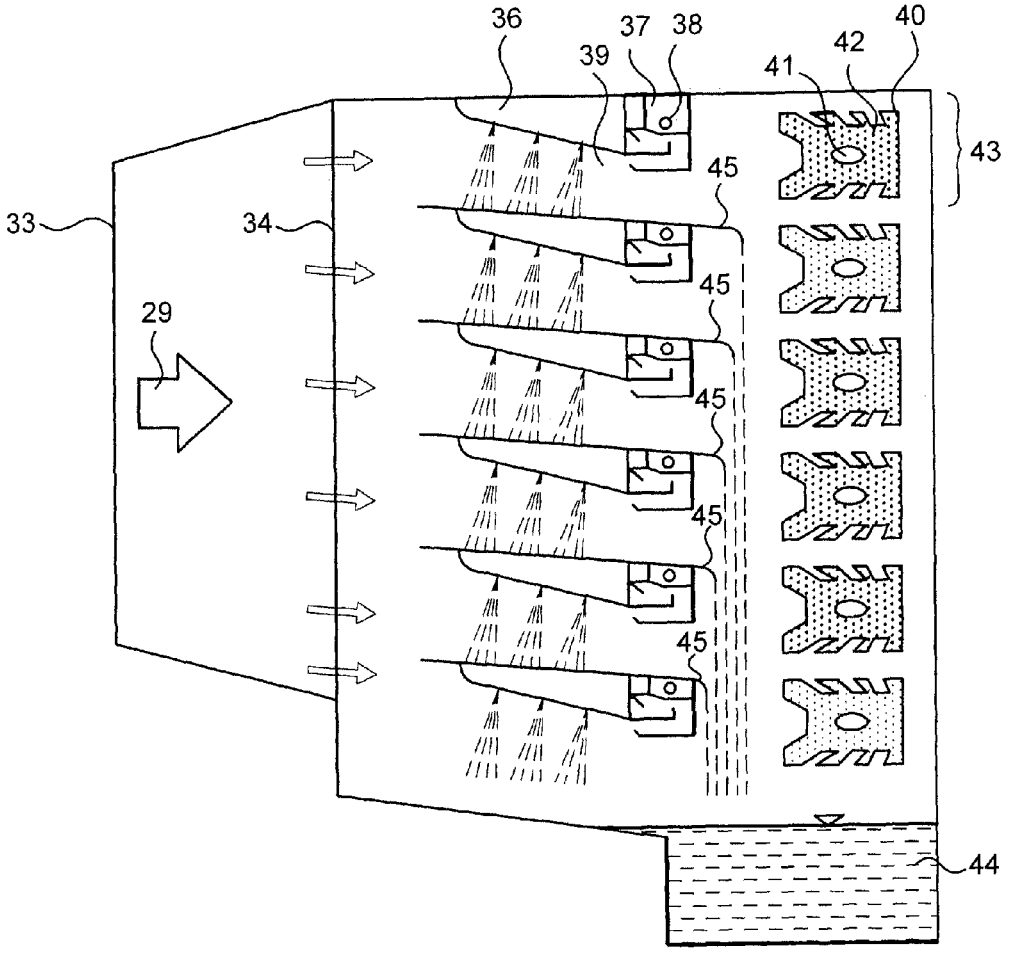
FIG. 8 is a schematic structure of a further embodiment connected to an axial or lateral exhaust turbine.

FIG. 8 depicts a hybrid condenser embodiment applied for an axial or lateral exhaust turbine with a horizontal steam inlet. The steam 29 coming horizontally from the transition piece 33 enters the hybrid condenser horizontally, through an inlet cross section 34 of the condenser. In the hybrid condenser, series connected direct contact/surface condenser modules 43 are located one below the other, in a nearly horizontal arrangement adjusted to the horizontal steam inlet. The steam 29 entering a direct contact condenser segment 39 of the modules 43 is first condensed on the water films emitted in a nearly vertical plane by the nozzles of a distributing chamber 36 of the direct contact condenser. After this, the condensation process continues on the trays (or fill) of after-coolers 37 adjoined to the distributing chambers 36. Again, a space for an air exhaust 38 is present within the after-coolers 37 of the direct contact condenser. Water guiding elements 45 of the series connected direct contact/surface condenser modules 43 include an angle of approx 5 to 10° with the horizontal, and slope downwards in the direction of steam flow. The bottom ends have a curve similar to a quarter circle and they are suitable for draining the cooling water and condensate mixture coming from the direct contact condenser segment 39, without disturbing the efficient operation of surface condenser segments 40 located downstream the direct contact condenser segments 39. In this case water guiding elements 45 are plates separating the direct contact condenser segments 39 from each other, sloping towards the surface condenser segments 40, and assisting the flow of the cooling water and condensate mixture between the direct contact condenser segments 39 and the surface condenser segments 40. Similarly to the earlier cases, each surface condenser segment 40 has a space 41 designed for air rejection. The cooling water and condensate mixture conducted by the water guiding elements 45 and the condensate drops coming from the surface condenser segments 40 are transferred to a cooling water and condensate collecting space 44 located at the bottom of the hybrid condenser.

Figure 9:
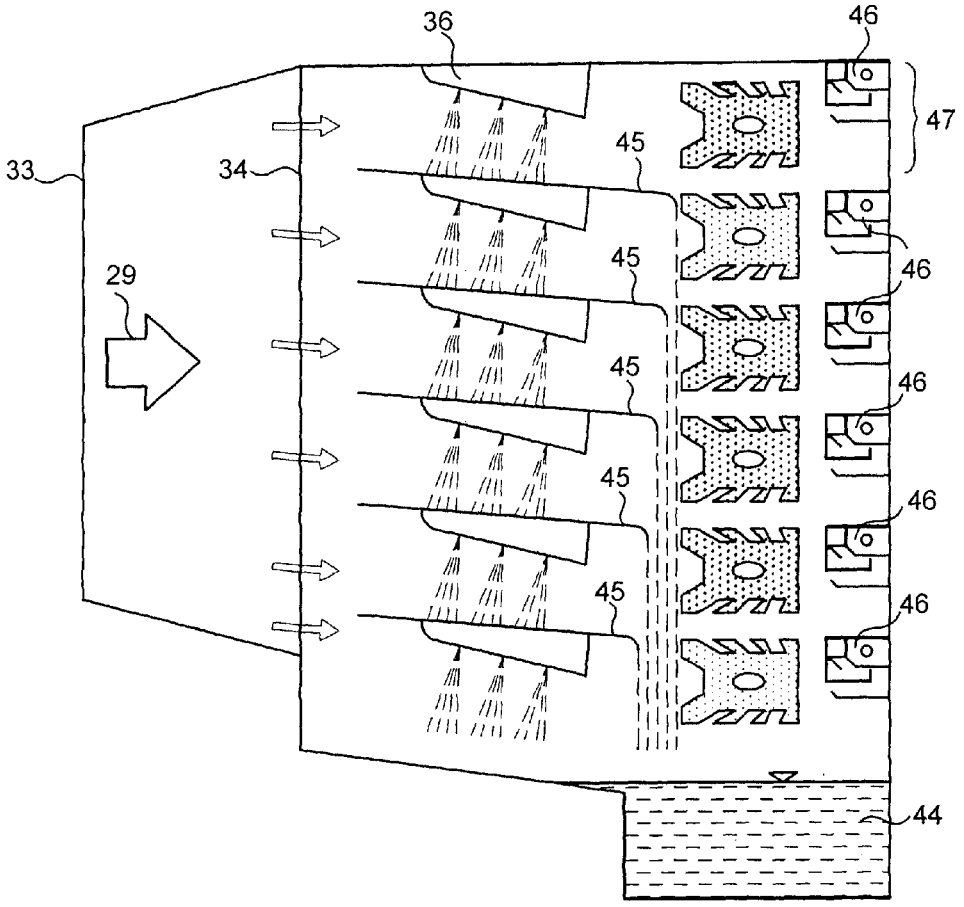
FIG. 9 is a schematic structure of an embodiment similar to that shown in FIG. 8, where the after-cooler of the direct contact condenser segments is located separately behind the surface condenser segments.

FIG. 9 shows a further preferred embodiment of a hybrid condenser adjoining an axial or lateral steam exhaust. A series connected direct contact/surface condenser module 47 differs from the module 43 shown in FIG. 8 in that in this case an after-cooler 46 of the direct contact condenser is not connected directly to the direct contact condenser segment distributing chamber 36 fitted with nozzles, but it is located in the space behind the surface condenser segment. Therefore, the cold cooling water coming to this point from the dry cooling circuit must be guided away by a separate distributing line not shown in FIG. 9.

Figure 10:
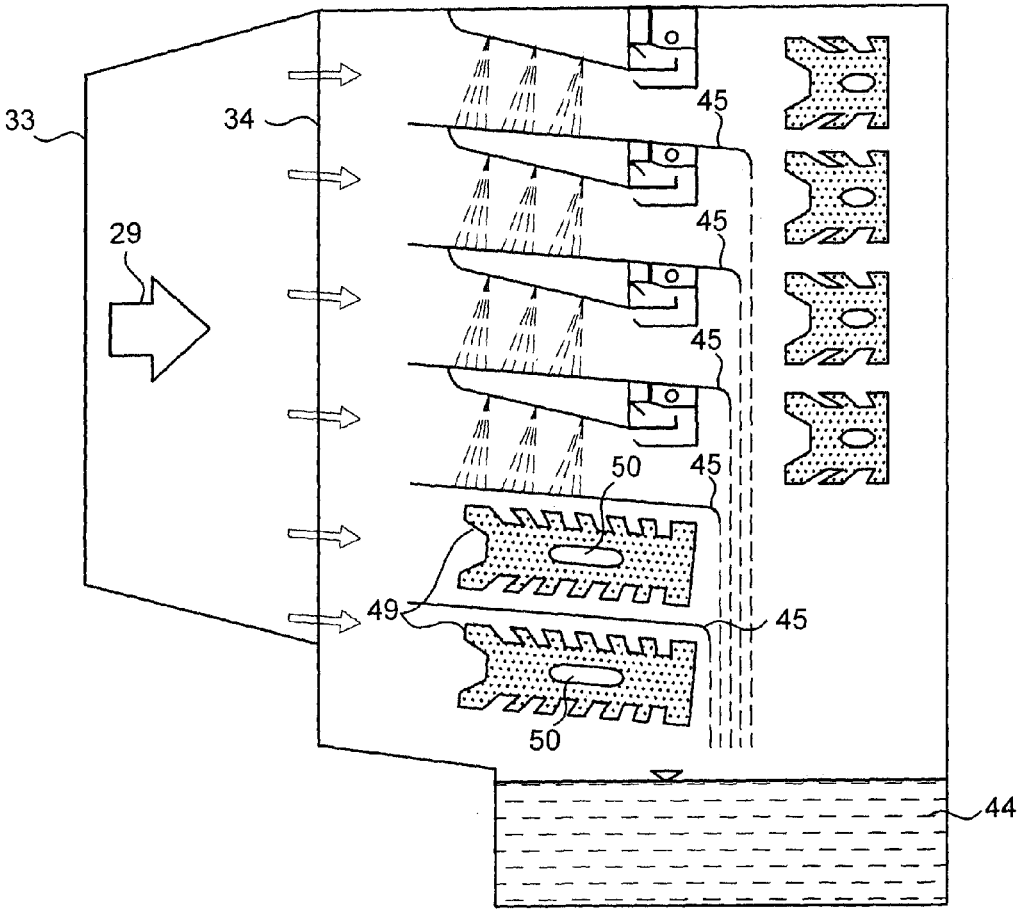
FIG. 10 is a schematic structure of an embodiment similar to that shown in FIG. 8, where in the lower section of the steam entering in a horizontal direction only surface condenser modules are located instead of the hybrid modules

FIG. 10 depicts another preferred embodiment of a hybrid condenser designed for an axial or lateral steam exhaust. In the case of an axial or lateral steam exhaust, the eventual size increase or arrangement of the condenser is less problematic from the aspect of the construction cost, and therefore the series connected direct contact/surface condenser modules 43, 47 (see FIG. 8 or FIG. 9) may be supplemented with purely surface condenser segments 49 at locations, which the direct contact condenser segments 39, are less favourable (because of the meandrous flow path), but at the same time they can be mounted in a position acceptable for the surface condenser parts, e.g. in the lower section of the hybrid condenser. They are also fitted with a separate air exhaust 50. The less favourable position does not disturb the operation (steam distribution) of the surface condenser segments 49 running with colder cooling water. This solution is preferred, if it is necessary to increase the proportion of wet cooling, e.g. in the periods of hottest ambient temperatures, when these coincide with the peak electricity demand. The solution shown in FIG. 10 on the one hand enables increasing the proportion of wet cooling, provided that this is allowed by the excess make-up water volume necessary for the wet cooling tower, and thus it improves the electrical power achievable in periods when the ambient temperatures are higher.

Figure 11:
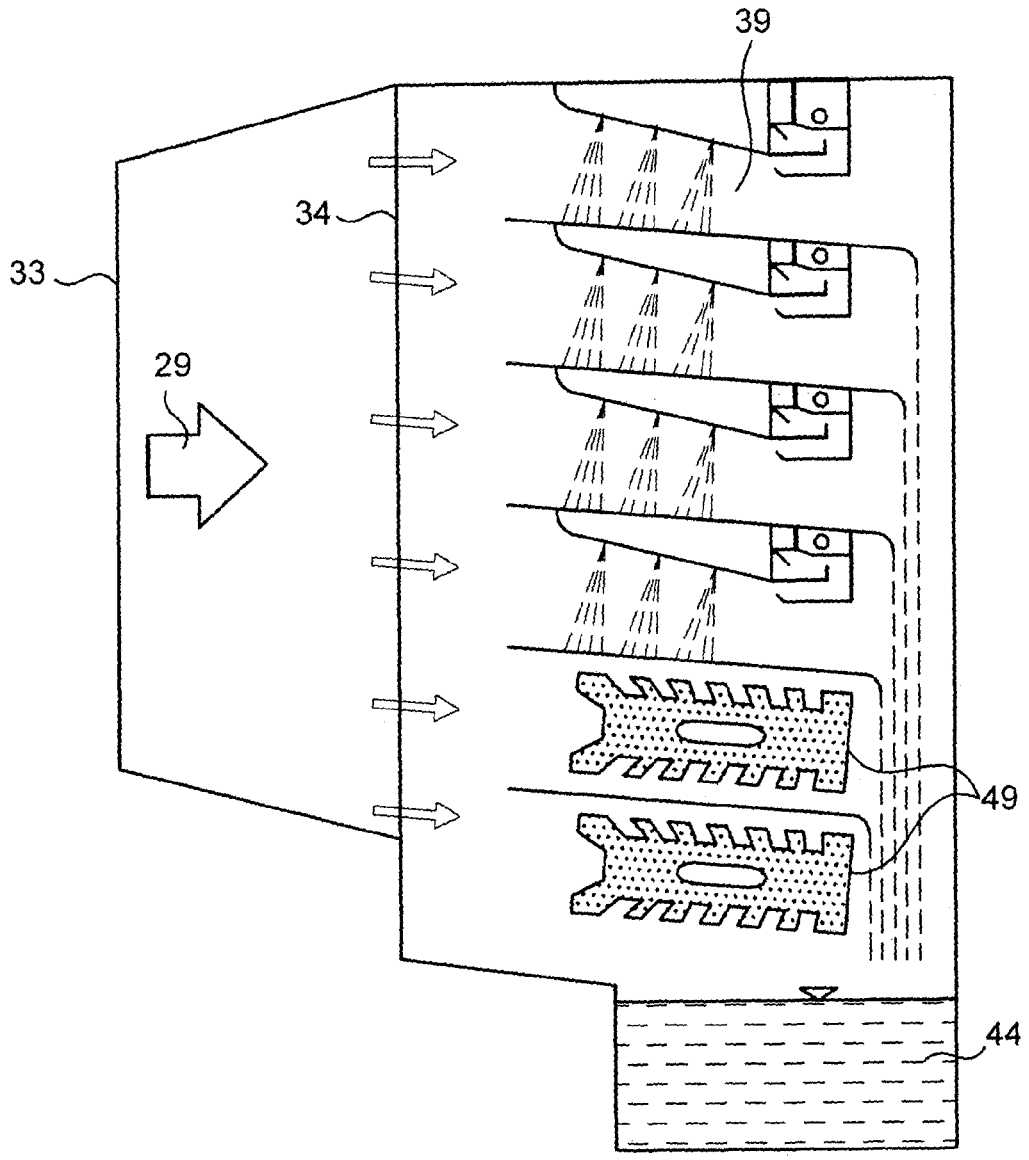
FIG. 11 is a schematic structure of an embodiment similar to that shown in FIG. 10, where there is no surface condenser segment behind the direct contact condenser segments.

Optionally, the surface condenser segments placed behind the direct contact condenser segments may even be omitted. The hybrid condenser presented in FIG. 11 is a variant of the solution shown in FIG. 10, where the direct contact condenser segments 39 do not include surface condenser segments connected in series with them. The surface condenser segments 49 located in the lower third or fourth section of the hybrid condenser below the direct contact condenser segments 39, therefore represent independent and separate modules, connected in parallel with the direct contact condenser segments. Hence, in the embodiments shown in the latter two figures, the water guiding element 45 and below it the surface condenser segment 40 is arranged under the bottom direct contact condenser segment 39. In this way, the water guiding elements 45 provide the advantages according to the invention also in this embodiment.

According to the discussion above, each direct contact and surface condenser segment, respectively, of the hybrid condenser comprises a space suitable for air rejection (i.e. for the removal of non-condensing gases), which is necessary for the efficient operation. From these, a common ejector, i.e. a deaerating system removes the mixture of non-condensing gases and some retained water vapour. During the operation, substantially different conditions arise in the two types of segments, for example when the wet cooled surface condenser segments are out of operation. Even in the case when the condenser parts are operated jointly, for example subject to the change of ambient temperature, the temperature difference of cold cooling water entering the dry cooled direct contact condenser segment and the wet cooled surface condenser segment changes. This temperature difference may become significant especially in the case of hot ambient temperatures. In accordance, the pressure of spaces for air removal from the direct contact condenser segments and pressure of those from the surface condenser segments, respectively, are different values. Lacking further measures, this could lead to the exhaust of a substantial volume of extra steam from the relevant space of the direct contact condenser segment, which has a higher pressure, while even the exhaust of non-condensing gases remains well below the desired value from the lower pressure space of the surface condenser segment. Therefore, it is advisable to apply regulating devices for example control valves in the respective collecting lines of the direct contact condenser segments and of the surface condenser segments of the hybrid condenser, which valves may be closed or opened independently, as well as controlled by the difference of inlet cold water temperatures.

The arrangement consisting of the parallel hybrid modules 12, 43 or 47 is very advantageous, because in such a design the largest possible steam inlet cross section is covered by direct contact condenser segments. The efficiency of hybrid condenser can be kept on the highest level also in periods when no assistance by the surface condenser segments is needed and only the direct contact condenser segments are in operation.

In the presented embodiments of the invention, the water guiding elements 17 and 45 are located practically in parallel with the main direction of steam flow. This is especially favourable because they do not cause a pressure loss or a deterioration of efficiency.

By virtue of the invention, the expressions 'downstream the direct contact condenser segment in the direction of steam flow' and 'below the direct contact condenser segment', respectively, mean that the surface condenser segments are located at least partly in the relevant places.

The invention is of course not limited to the preferred embodiments shown in details in the figures, and further variants and modifications are possible within the scope defined by the following claims.

The invention claimed is:

1. A hybrid condenser, comprising at least two modules, each module including a direct contact condenser segment and a surface condenser segment arranged in a common condensation space, wherein the surface condenser segment is arranged downstream of the direct contact condenser segment in the direction of steam flow, a water guiding element located between the at least two modules, thereby to ensure that cooling water and condensate mixture generated in the direct contact condenser segment flow downward so as to avoid the surface condenser segment, further characterised in that in the modules, the surface condenser segment is arranged below the direct contact condenser segment, and each water guiding element is made of a vertically arranged plate or a perforated flat material, and further characterised in that at the bottom end of the water guiding elements, elements generating water spray from the flowing down cooling water and condensate mixture are arranged.

2. A hybrid condenser, comprising at least two modules, each module including a direct contact condenser segment and a surface condenser segment arranged in a common condensation space, wherein the surface condenser segment is arranged downstream of the direct contact condenser segment in the direction of steam flow, a water guiding element located between the at least two modules, thereby to ensure that cooling water and condensate mixture generated in the direct contact condenser segment flow downward so as to avoid the surface condenser segment, further characterised in that in the modules, the surface condenser segment is arranged below the direct contact condenser segment, and each water guiding element is made of a vertically arranged plate or a perforated flat material, and further characterised in that on the outer side of each outermost module there is also a water guiding element, arranged with a spacing from the respective sidewalls of the hybrid condenser, in a way that they form a gap which allows the steam flow to bypass the modules.

3. A hybrid condenser, comprising at least two modules, each module including a direct contact condenser segment and a surface condenser segment arranged in a common condensation space, wherein the surface condenser segment is arranged downstream of the direct contact condenser segment in the direction of steam flow, a water guiding element located between the at least two modules, thereby to ensure that cooling water and condensate mixture generated in the direct contact condenser segment flow downward so as to avoid the surface condenser segment, further characterised in that in the modules, the surface condenser segment is arranged below the direct contact condenser segment, and each water guiding element is made of a vertically arranged plate or a perforated flat material, and further characterised in that on the outer side of each outermost module there is also a water guiding element, arranged with a spacing from the respective sidewalls of the hybrid condenser, and in these spaces further surface condenser segments are arranged.

4. A hybrid condenser, comprising at least two modules, each module including a direct contact condenser segment and a surface condenser segment arranged in a common condensation space, wherein the surface condenser segment is arranged downstream of the direct contact condenser segment in the direction of steam flow, a water guiding element located between the at least two modules, thereby to ensure that cooling water and condensate mixture generated in the direct contact condenser segment flow downward so as to avoid the surface condenser segment, and further characterised in that the modules are arranged one below the other and designed for horizontal steam inlet, and the water guiding elements are plates separating the direct contact condenser segments from each other, sloping towards the surface condenser segments and assisting the flowing of the cooling water and condensate mixture down between the direct contact condenser segments and the surface condenser segments.

5. A hybrid condenser, comprising a direct contact condenser segment and a surface condenser segment arranged in a common condensation space, wherein the surface condenser segment is arranged downstream of the direct contact condenser segment in the direction of steam flow or below the direct contact condenser segment, and a water guiding element ensuring that cooling water and condensate mixture generated in the direct contact condenser segment flows downward avoiding the surface condenser segment, characterised in that the direct contact condenser segment has nozzles emitting water jets transversally to the direction of steam flow, and the water guiding element has a water receiving surface facing the nozzles, and further characterised in that below the bottom direct contact condenser segment, a water guiding element and below it a surface condenser segment are arranged.

6. A hybrid condenser, comprising a direct contact condenser segment and a surface condenser segment arranged in a common condensation space, wherein the surface condenser segment is arranged downstream of the direct contact condenser segment in the direction of steam flow or below the direct contact condenser segment, and a water guiding element ensuring that cooling water and condensate mixture generated in the direct contact condenser segment flows downward avoiding the surface condenser segment, characterised in that the direct contact condenser segments and the surface condenser segments have separate air exhausts, which are connected to a common deaerating apparatus, and the air exhausts are designed to be controllable.

* * * * *